US011651885B2

(12) United States Patent
Zhao et al.

(10) Patent No.: US 11,651,885 B2
(45) Date of Patent: May 16, 2023

(54) MAGNETIC CORE INDUCTORS

(71) Applicant: Intel Corporation, Santa Clara, CA (US)

(72) Inventors: Junnan Zhao, Gilbert, AZ (US); Ying Wang, Chandler, AZ (US); Cheng Xu, Chandler, AZ (US); Kyu Oh Lee, Chandler, AZ (US); Sheng Li, Gilbert, AZ (US); Yikang Deng, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 522 days.

(21) Appl. No.: 16/637,006

(22) PCT Filed: Sep. 28, 2017

(86) PCT No.: PCT/US2017/053859
§ 371 (c)(1),
(2) Date: Feb. 6, 2020

(87) PCT Pub. No.: WO2019/066832
PCT Pub. Date: Apr. 4, 2019

(65) Prior Publication Data

US 2020/0168384 A1 May 28, 2020

(51) Int. Cl.
*H01F 17/00* (2006.01)
*H01F 27/255* (2006.01)

(52) U.S. Cl.
CPC ..... *H01F 17/0013* (2013.01); *H01F 27/255* (2013.01); *H01F 2017/002* (2013.01); *H01F 2017/0066* (2013.01)

(58) Field of Classification Search
CPC ..... H01F 17/0013; H01F 27/255; H01F 2017/003; H01F 2017/006
See application file for complete search history.

(56) References Cited

U.S. PATENT DOCUMENTS

2014/0159851 A1 6/2014 Mano et al.

FOREIGN PATENT DOCUMENTS

JP 3920294 B2 5/2007
JP 2017017223 A 1/2017
(Continued)

OTHER PUBLICATIONS

International Search Report and Written Opinion in International Patent Application No. PCT/US2017/053859 dated Jun. 28, 2018, 9 pages.

*Primary Examiner* — Dinh T Le
(74) *Attorney, Agent, or Firm* — Akona IP PC

(57) ABSTRACT

Described herein are magnetic core inductors (MCI) and methods for manufacturing magnetic core inductors. A first embodiment of the MCI can be a snake-configuration MCI. The snake-configuration MCI can be formed by creating an opening in a base material, such as copper, and providing a nonconductive magnetic material in the opening. The inductor can be further formed by forming plated through holes into the core material. The conductive elements for the inductor can be formed in the plated through holes. The nonconductive magnetic material surrounds each conductive element and plated through hole. In embodiments, a layered coil inductor can be formed by drilling a laminate to form a cavity through the laminate within the metal rings of the layered coil inductor. The nonconductive magnetic material can be provided in the cavity.

11 Claims, 14 Drawing Sheets

(56) References Cited

FOREIGN PATENT DOCUMENTS

| | | | | |
|---|---|---|---|---|
| KR | 100973447 | B1 | | 8/2010 |
| WO | WO2014021194 | | * | 2/2014 |
| WO | 2016011313 | A1 | | 1/2016 |
| WO | 2019066832 | A1 | | 4/2019 |

* cited by examiner

214

216

MAGNETIC CORE INDUCTORS

CROSS-REFERENCE TO RELATED APPLICATION

This application is a national stage application under 35 U.S.C. § 371 of PCT International Application Serial No. PCT/US2017/053859, filed on Sep. 28, 2017 and entitled "MAGNETIC CORE INDUCTORS," which is hereby incorporated by reference herein in its entirety.

BACKGROUND

Inductors may be used as energy storage elements in voltage regulators, and the performance of voltage regulators can be linked to the characteristics of the inductors used.

Figures may not be drawn to scale.

DETAILED DESCRIPTION

Described herein are magnetic core inductors and methods of making magnetic core inductors. In the following description, various aspects of the illustrative implementations will be described using terms commonly employed by those skilled in the art to convey the substance of their work to others skilled in the art. However, it will be apparent to those skilled in the art that the present disclosure may be practiced with only some of the described aspects. For purposes of explanation, specific numbers, materials, and configurations are set forth in order to provide a thorough understanding of the illustrative implementations. However, it will be apparent to one skilled in the art that the present disclosure may be practiced without the specific details. In other instances, well-known features are omitted or simplified in order not to obscure the illustrative implementations.

Various operations will be described as multiple discrete operations, in turn, in a manner that is most helpful in understanding the present disclosure, however, the order of description should not be construed to imply that these operations are necessarily order dependent. In particular, these operations need not be performed in the order of presentation.

The terms "over," "under," "between," and "on" as used herein refer to a relative position of one material layer or component with respect to other layers or components. For example, one layer disposed over or under another layer may be directly in contact with the other layer or may have one or more intervening layers. Moreover, one layer disposed between two layers may be directly in contact with the two layers or may have one or more intervening layers. In contrast, a first layer "on" a second layer is in direct contact with that second layer. Similarly, unless explicitly stated otherwise, one feature disposed between two features may be in direct contact with the adjacent features or may have one or more intervening layers.

A fully integrated voltage regulator (FIVR) is a voltage regulator that is integrated into a package substrate or a die. FIVRs may use high frequency inductors incorporated in the central processing unit (CPU) packages. The output voltage ripple of FIVR may be inversely proportional to its inductance and thus FIVR performance may improve by increasing the inductance.

This disclosure describes a magnetic core inductor (MCI) having a nonconductive magnetic paste in the inductor core. The nonconductive magnetic paste can be formulated by mixing silica coated magnetic particles with resin paste, which can exhibit superior magnetic permittivity than an air core. Nonconductive magnetic materials in the inductor core may mitigate signal crosstalk.

Figure 1:
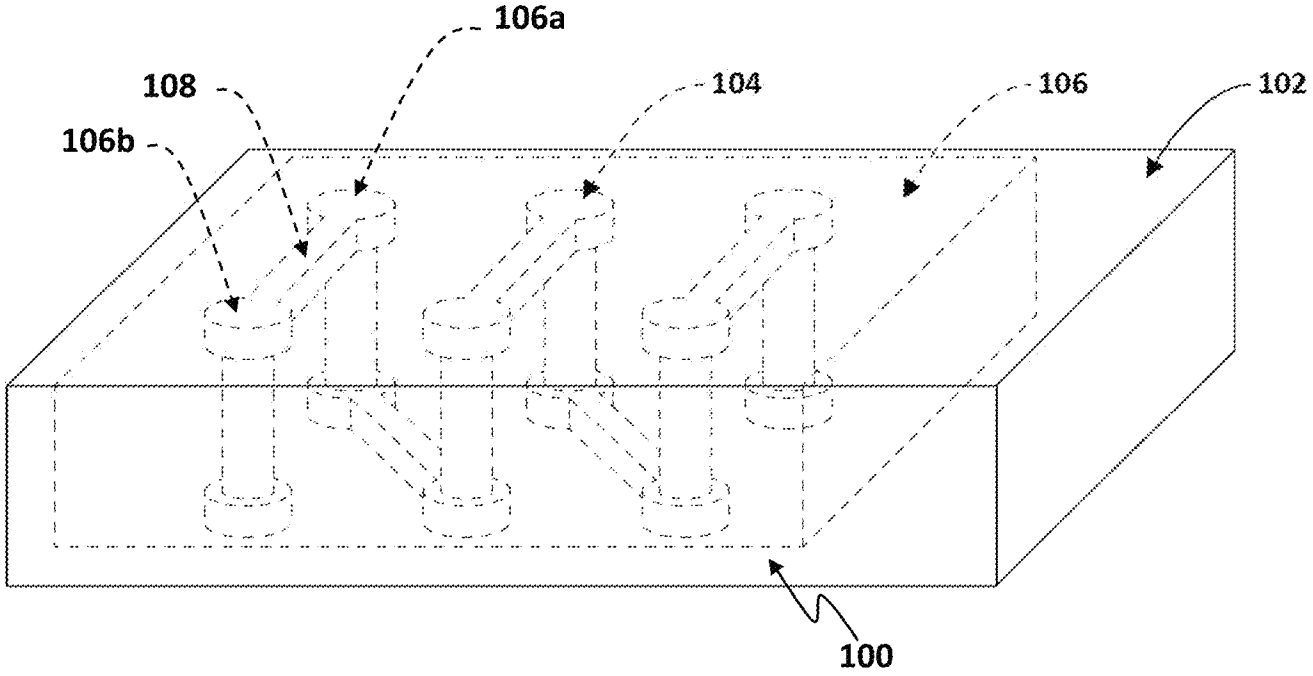
FIG. 1 is a schematic diagram of a magnetic core inductor in accordance with some embodiments of the present disclosure.

FIG. 1 is a schematic diagram of a magnetic core inductor (MCI) 100 in accordance with embodiments of the present disclosure. The MCI 100 includes a snake inductor 104 that is surrounded by and filled with a nonconductive magnetic material 106. The snake inductor 104 can include a serpentine configuration of plated through-holes (PTHs), such as PTH 106*a* and PTH 106*b* that are connected in series. PTH 106*a* can be electrically connected to PTH 106*b* by an interconnect 108. The snake inductor 104 can include a plurality of PTHs interconnected in a similar manner. Surrounding and between the PTHs of the snake inductor 104 is a nonconductive magnetic material 106. The MCI 100 is formed in a core material 102. The core material 102 can include a polymer composite material with a metal cover, such as a copper cover. The core material 102 can also support other through holes for routing purposes that do not include the MCI 100.

Figure 2A:
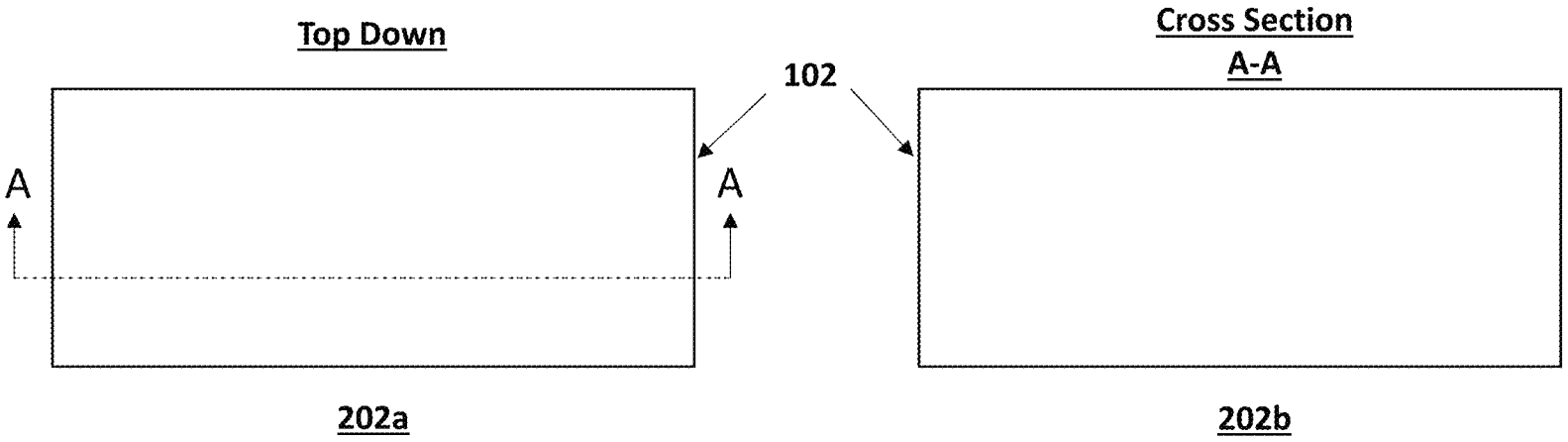
FIGS. 2A-H are schematic diagrams illustrating a process flow for forming a magnetic core inductor in accordance with some embodiments of the present disclosure.
Figure 2B:
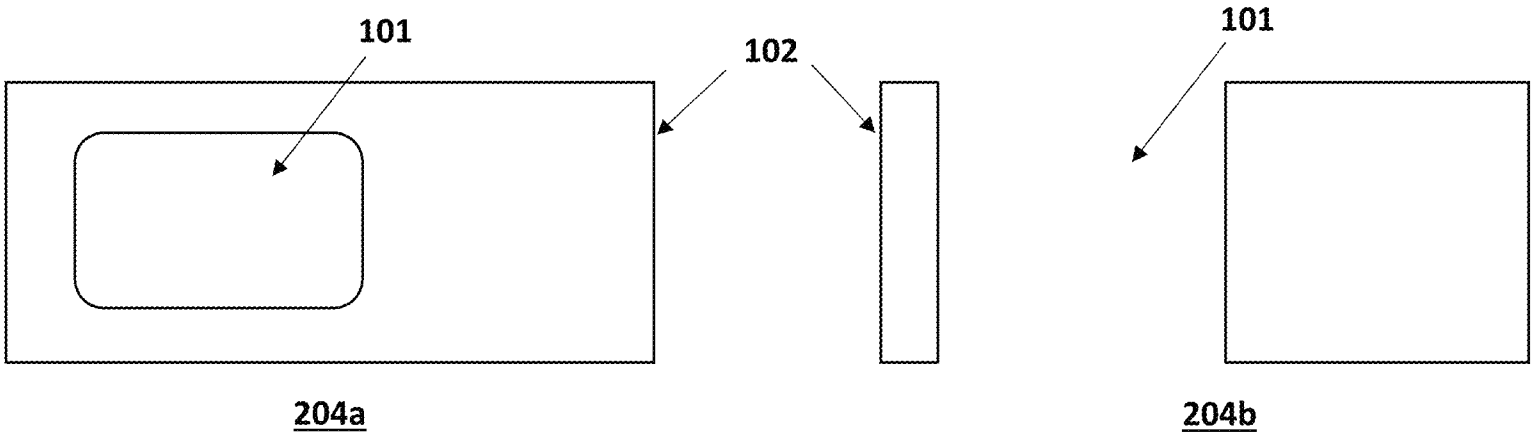
Figure 2C:
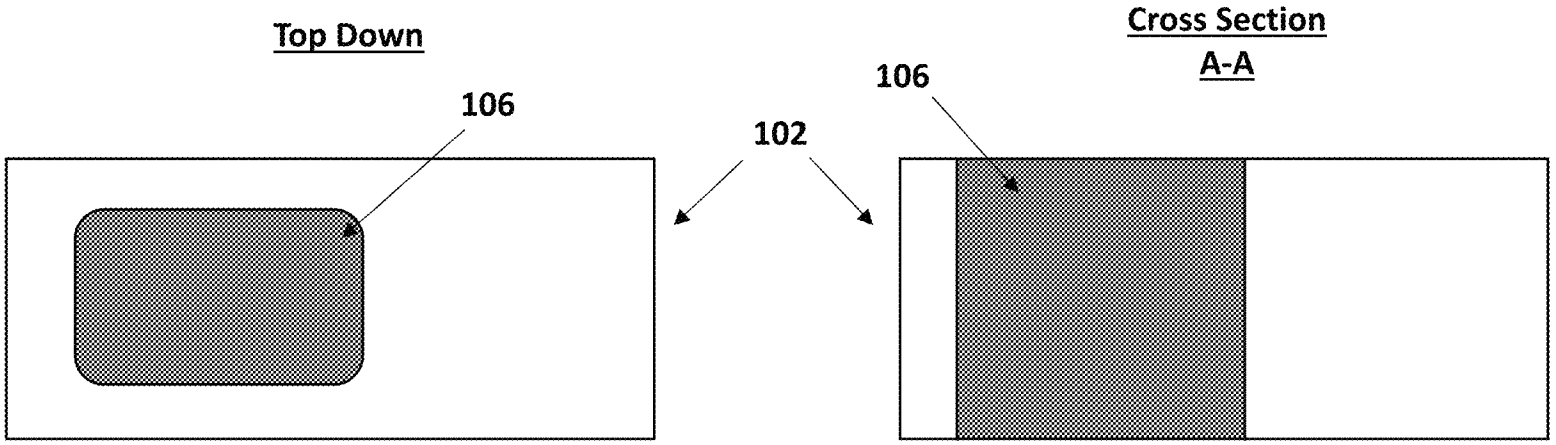
Figure 2D:
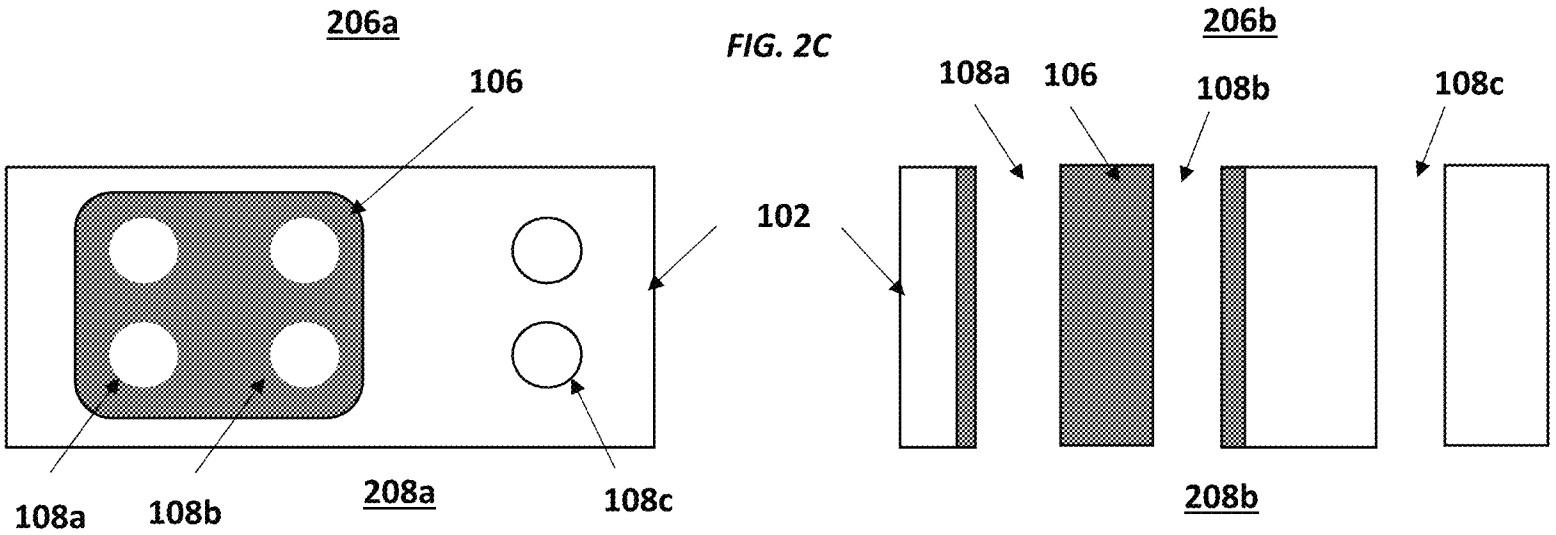
Figure 2E:
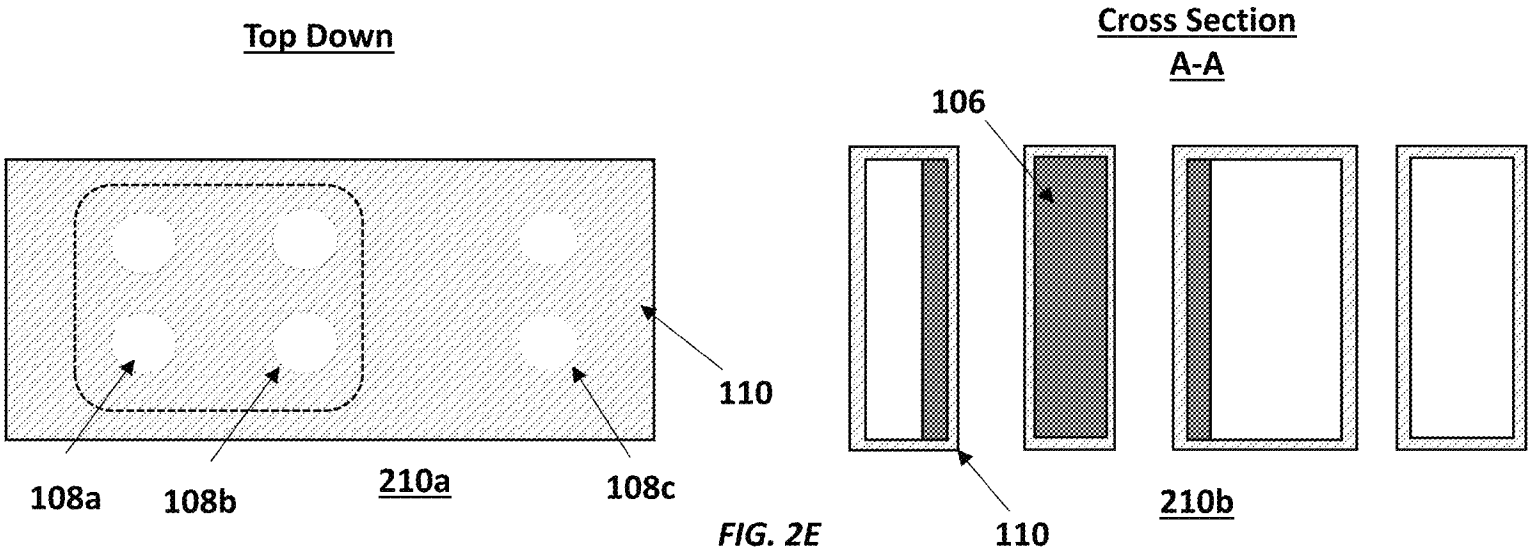
Figure 2F:
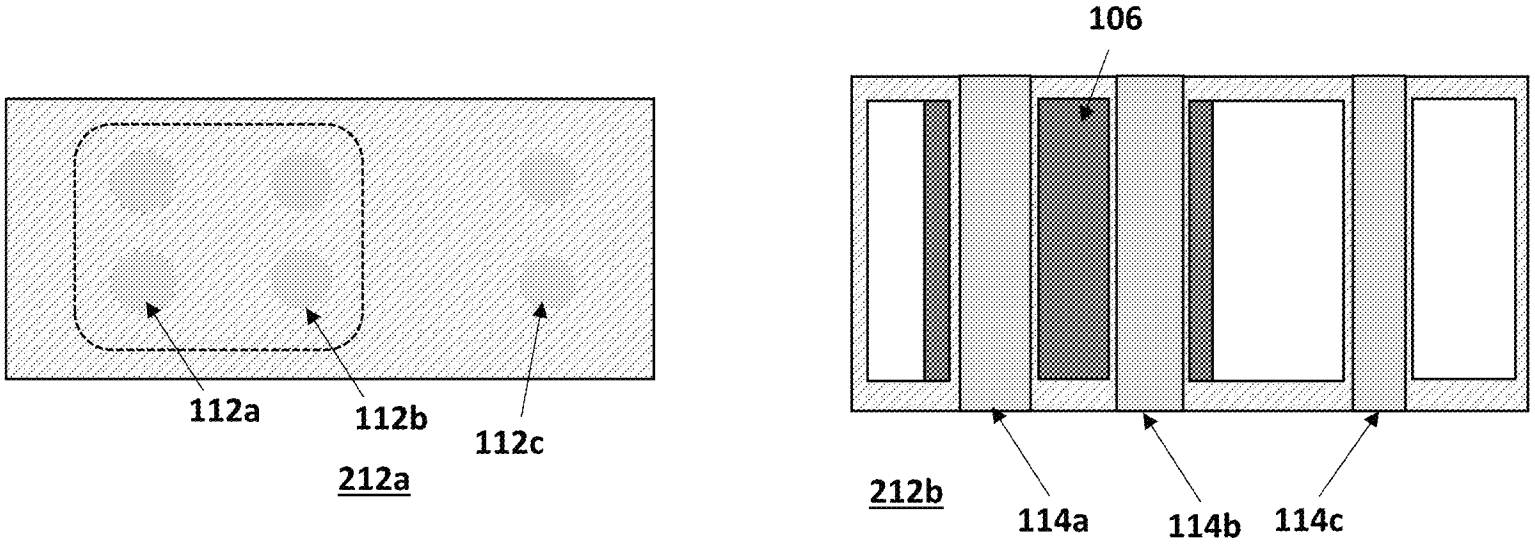
Figure 2G:
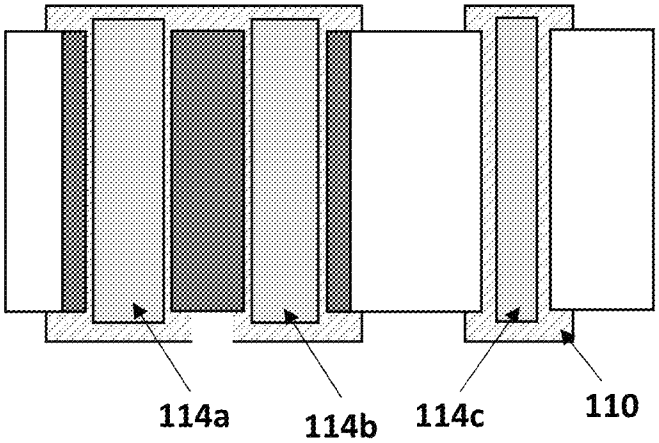
Figure 2H:
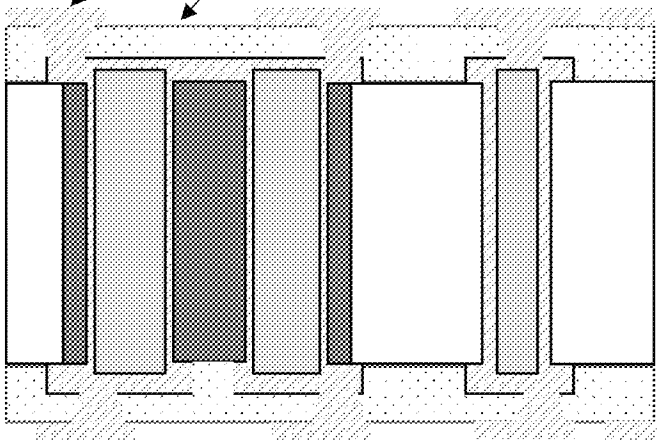

FIGS. 2A-H are schematic diagrams illustrating a process flow for forming an MCI in accordance with embodiments of the present disclosure. In FIGS. 2A-F, a top down view is shown next to a cross-sectional view through A-A. In FIGS. 2G-H, only the cross-sectional views through A-A are shown. In FIG. 2A, a top down view 202*a* and a cross-sectional cut 202*b* of the core material 102 is provided. FIG. 2A shows the cross-sectional cut A-A.

In FIG. 2B, an opening 101 in the core material 102 is formed (204*a-b*). The opening 101 can be formed using a router or other drilling tool. The opening 101 can be formed in a portion of the core material 102, leaving other space available for through holes that do not include the inductor. The opening 101 is formed through the region where the snake PTH inductor is to reside. The opening 101 on the snake inductor region is prepared for filling magnetic paste.

In FIG. 2C, the nonconductive magnetic material 106 can be provided (206*a-b*). The nonconductive magnetic material 106 can be a paste that includes an epoxy, or other resin material as a matrix with nonconductive magnetic materials as a filler to the matrix. The nonconductive magnetic material 106 can be provided into the opening 101. The nonconductive magnetic material 106 can be cured and grinded for smoothness.

In FIG. 2D, the through holes can be formed (208*a-b*). The MCI through holes 108*a-b* can be formed through the nonconductive magnetic material 106. Non-MCI through holes 108*c* can be drilled through the core material 102. The through holes 108*a-c* can be mechanically drilled and desmeared.

In FIG. 2E, electroless plating can be used as seeding layer for metal plating 110 on the through hole side walls (212*a-b*), followed by an electrolytic plating of copper.

In FIG. 2F, the plugging resin 114*a-c* can be plugged into the PTHs 108*a-c* (212*a-b*), followed by grinding or planarizing. In FIG. 2G, the PTH lid can be plated followed by patterning of metal layer, including the formation of through holes covering pads (214). In FIG. 2H, a dielectric material 118 can be formed on the patterned metal layer and Cu shape 116 can be formed (216). In embodiments, a dielectric material 118 can be formed between the metal plating 110 and the contacts 116.

Figure 3:
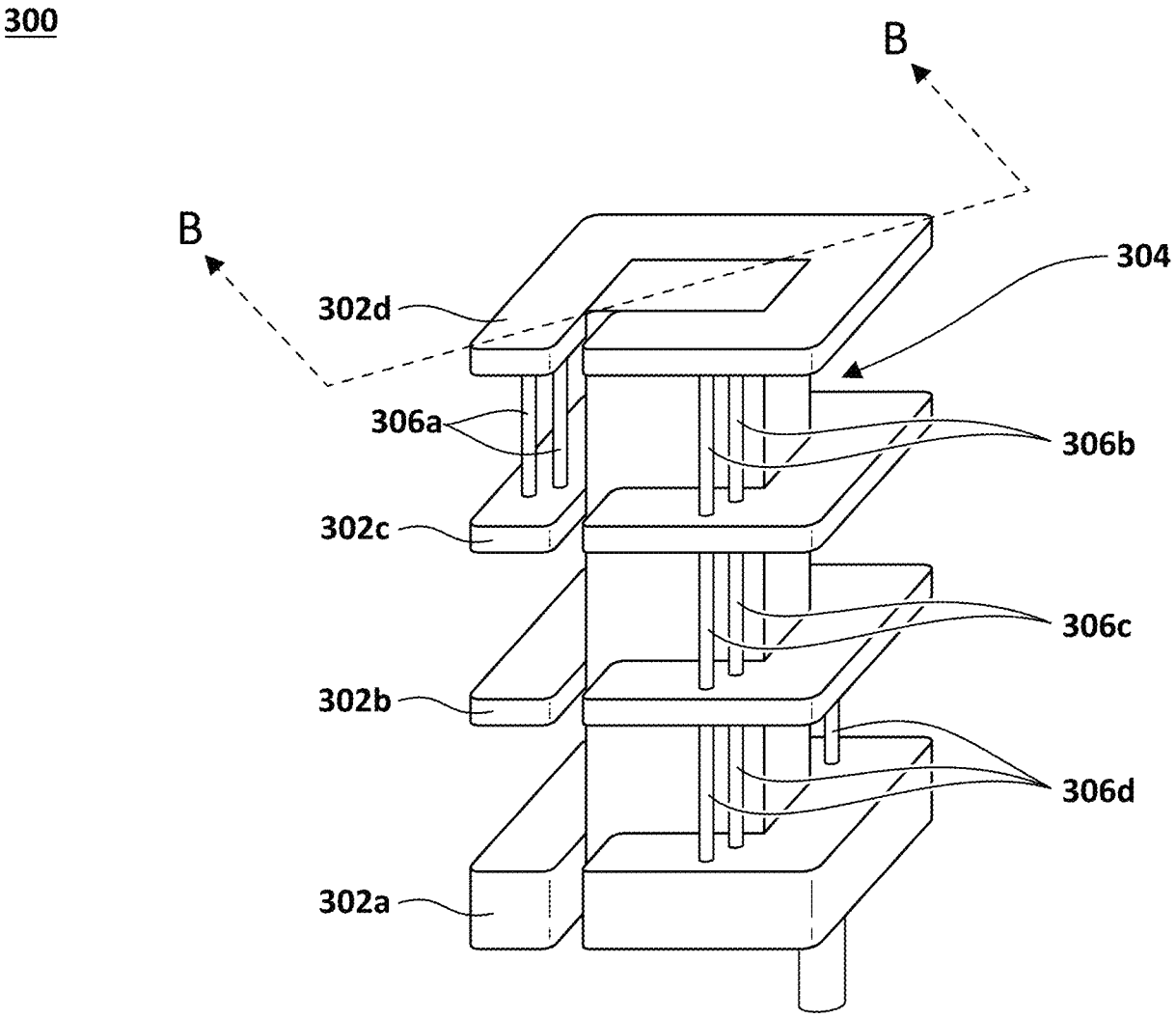
FIG. 3 is a schematic diagram of a layered magnetic core inductor in accordance with some embodiments of the present disclosure.

FIG. 3 is a schematic diagram of a layered magnetic core inductor (MCI) 300 in accordance with embodiments of the present disclosure. The layered MCI 300 can be an inductor that includes a plurality of interconnected conductive layers that form the inductor coils. In the example of FIG. 3, the layered MCI 300 includes a first layer 302*a*, a second layer 302*b*, a third layer 302*c*, and a fourth layer 304*d*. The first layer 302*a* may be referred to as a bottom layer 302*a* and the fourth layer 302*d* can be referred to as a top layer 302*d*, though it is understood that any number of layers for the layered MCI 300 are contemplated by this disclosure. The metal layers can be interconnected by metal vias. For example, the fourth layer 302*d* can be electrically coupled to the third layer 302*c* by a metal via 306*a* and via 306*b*. The third layer 302*c* can be electrically coupled to the second layer 302*b* by a metal via 306*c*. The second layer 302*b* can be electrically coupled to the first layer 302*a* by a metal via 306*d*. The magnetic core 304 is also illustrated. It is understood that FIG. 3 illustrates a representation of the layered MCI 300. FIG. 3 omits the underlying core material, laminate, and other elements for ease of illustration.

FIGS. 4A-D and FIGS. 5A-E illustrate example process flows for forming a layered MCI in accordance with embodiments of the present disclosure. FIGS. 4A-D and 5A-E show a cross section of the structure of FIG. 3 through B-B. The layered MCI 300 is created by creating a cavity inside an ACI across BU layers for selectively adding nonconductive magnetic paste. FIGS. 4A-D illustrate a first process that includes a depth controlled router; FIGS. 5A-E illustrate a second process that includes the use of a laser drill with dummy pad at the bottom layer 302*a* as laser stopper.

In the process flow, there are three layers of the laminate material (e.g., a build-up film) and four layers of Cu, though it is understood that the number of layers can be different than what is shown. To accommodate the formation of the magnetic core, the process flow includes increasing the thickness of the topmost BU layer 5-10 μm thicker than target thickness, which leaves a margin for subsequent magnetic paste grinding or planarizing post cavity formation and magnetic paste loading.

FIGS. 4A-E are schematic diagrams illustrating a process flow for forming a layered MCI in accordance with embodiments of the present disclosure. In a first embodiment, shown in FIG. 4A, copper pads 406 are formed on the core material 402 until a penultimate copper layer 407 is formed. The laminate 404 is also formed for each copper pad 406. The laminate can be a buildup film, such as ABF (TM). After the penultimate copper layer 407 is formed, a topmost laminate strata is formed 5-10 μm thicker than final target laminate thickness.

Figure 4A:
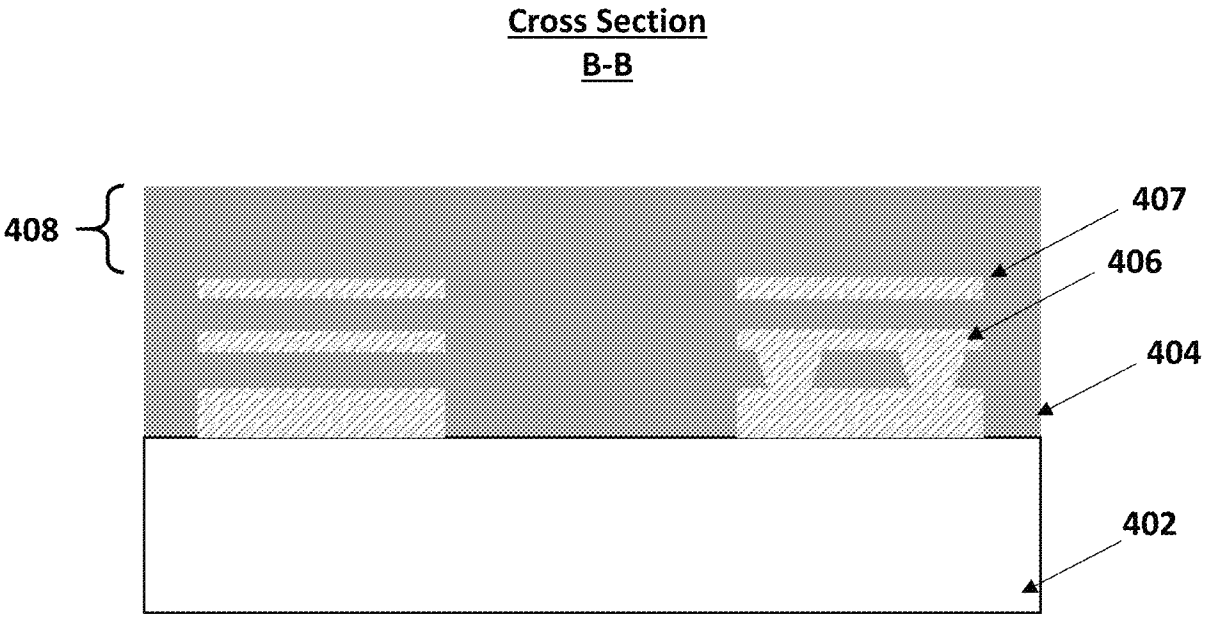
FIGS. 4A-E are schematic diagrams illustrating a process flow for forming a layered magnetic core inductor in accordance with some embodiments of the present disclosure.
Figure 4B:
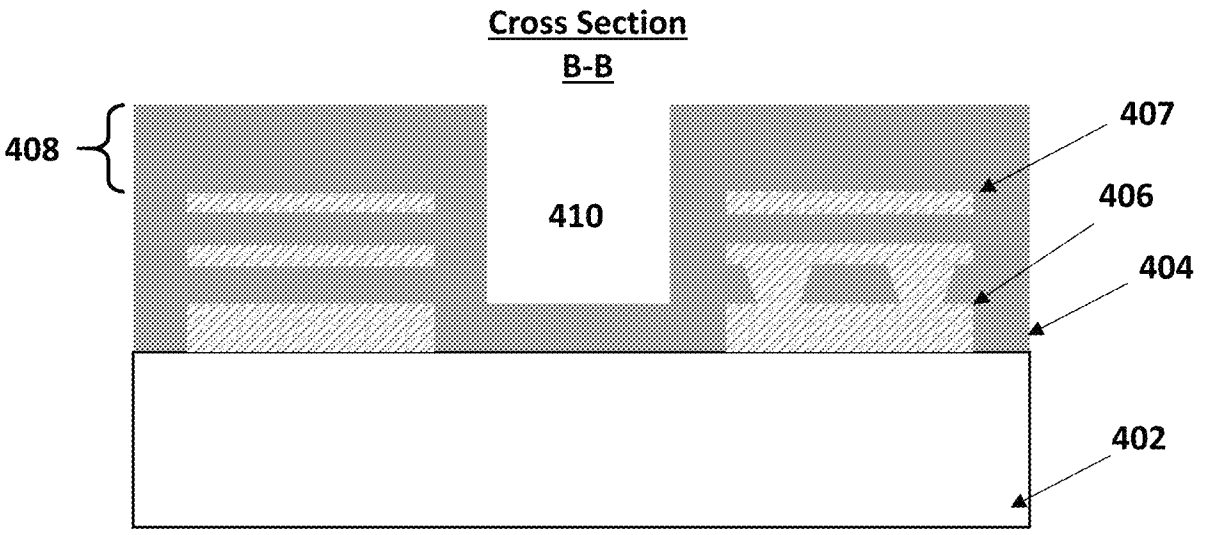
Figure 4C:
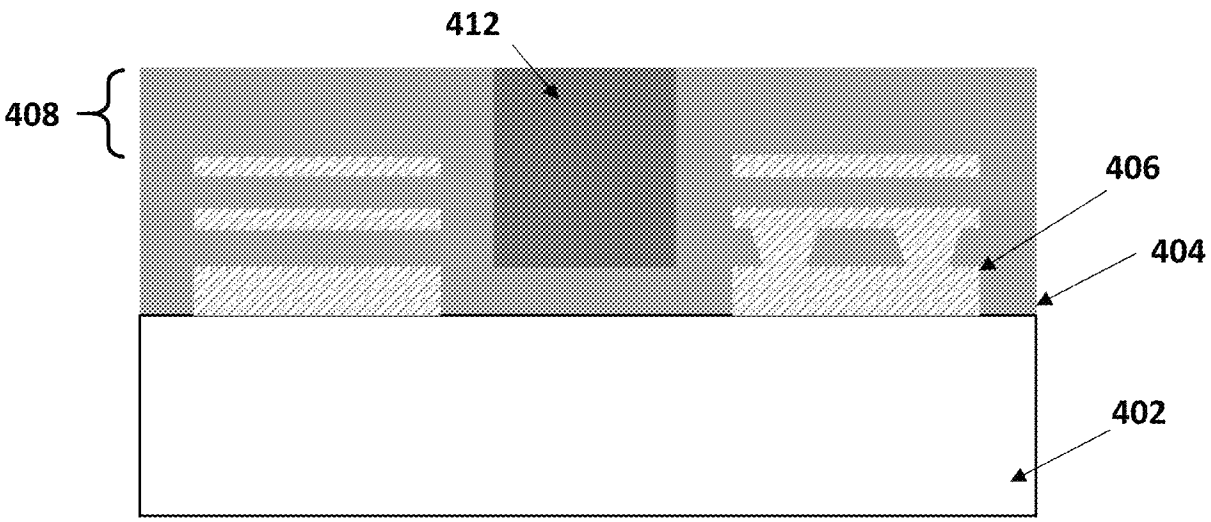

In FIG. 4B, a cavity 410 is created using depth controlled router. The cavity 410 is made through the laminate 404 to form a cavity within the copper layers 406 of the inductor. In FIG. 4C, the nonconductive magnetic material 412 is added to the cavity. The nonconductive magnetic material 412 can be a paste or other viscous material that can be added through an injection process, such as a plugging process. The nonconductive magnetic material 412 can be cured to allow the material to set.

Figure 4D:
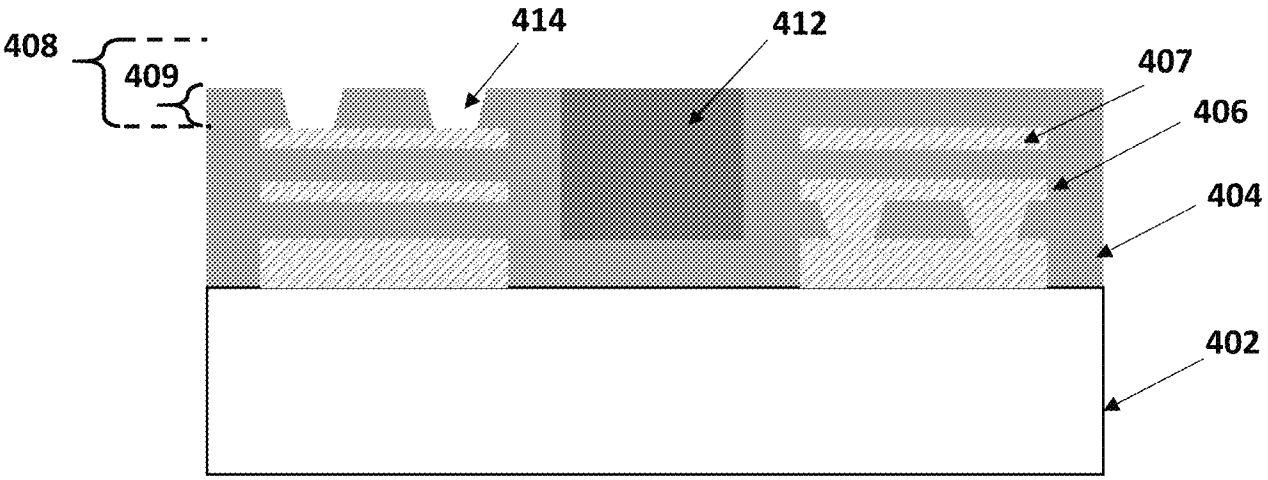
Figure 4E:
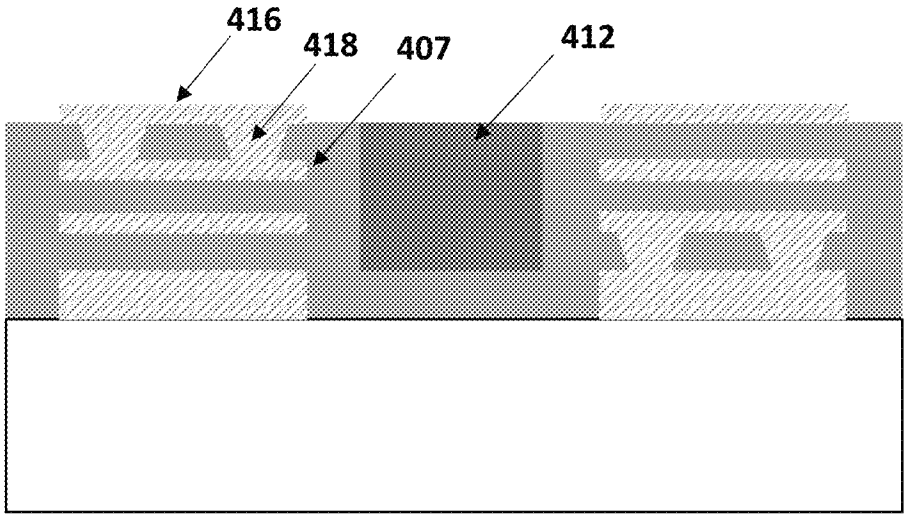

In FIG. 4D, the top layer of the laminate and the nonconductive magnetic material 412 is grinded to the target thickness 409, which is less than the laminate thickness 408. A laser-based via formation can be used to form vias 414 to provide access to the penultimate copper layer 407. In FIG. 4E, the top copper layer 416 can be formed. The top copper layer 416 can be electrically connected to the penultimate copper layer 407 by copper contact vias 418.

Figure 5A:
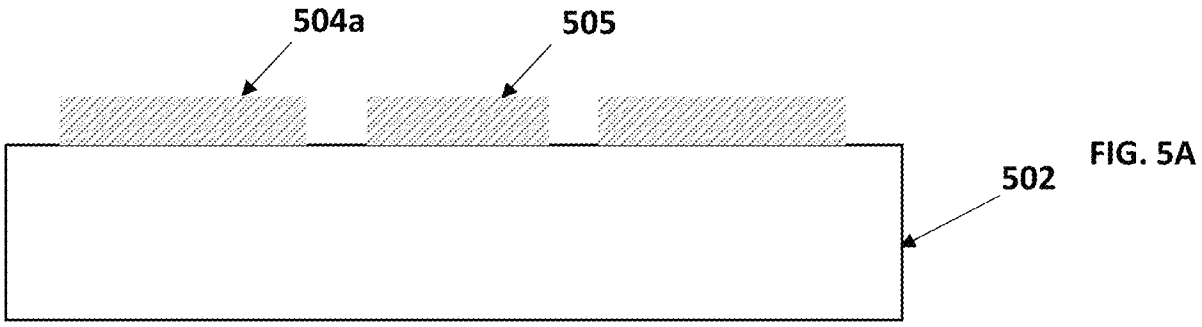
FIGS. 5A-F are schematic diagrams illustrating a process flow for forming a layered magnetic core inductor in accordance with other embodiments of the present disclosure.
Figure 5B:
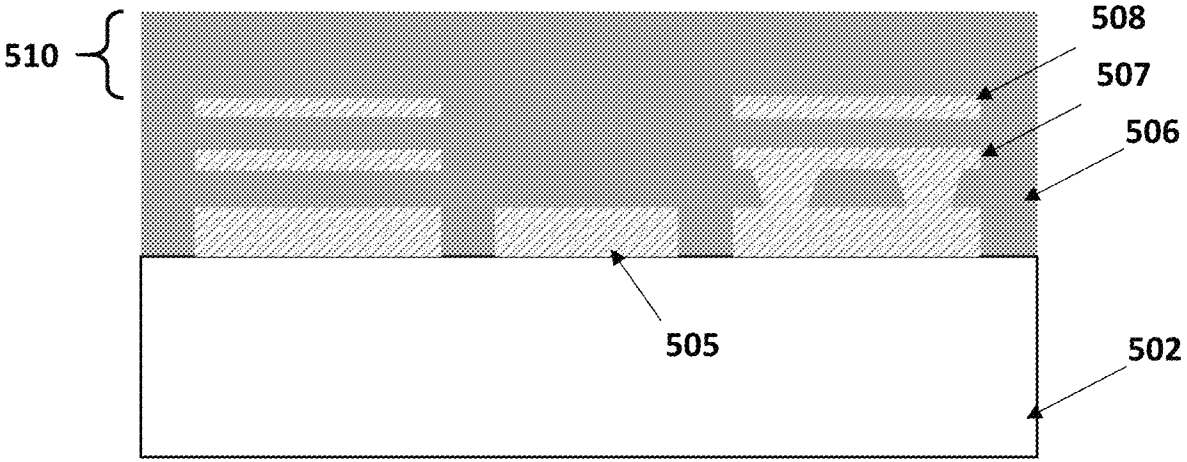
Figure 5C:
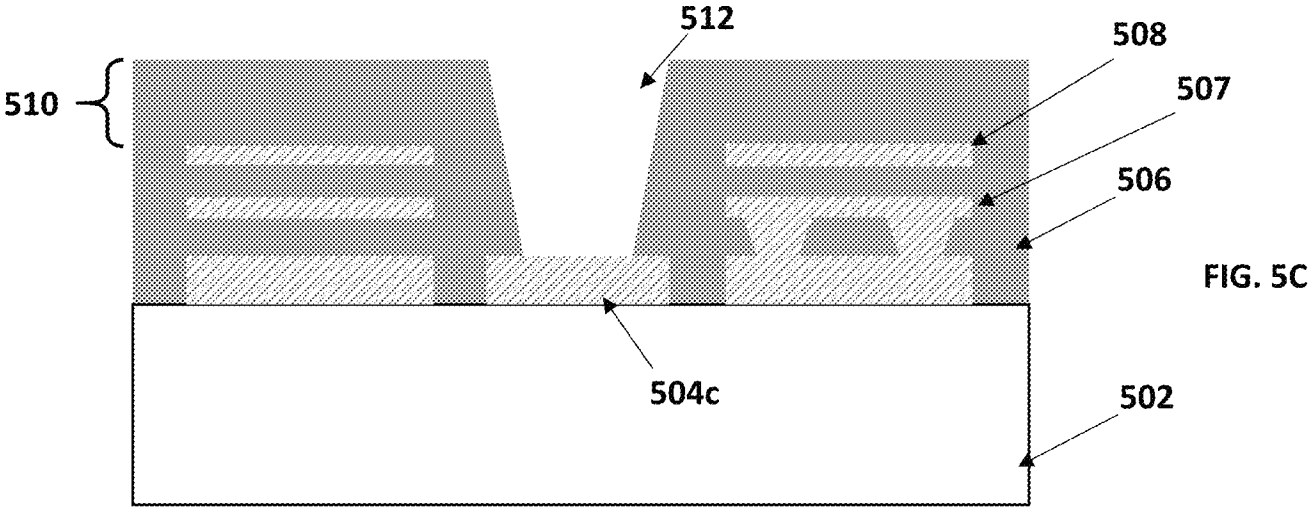
Figure 5D:
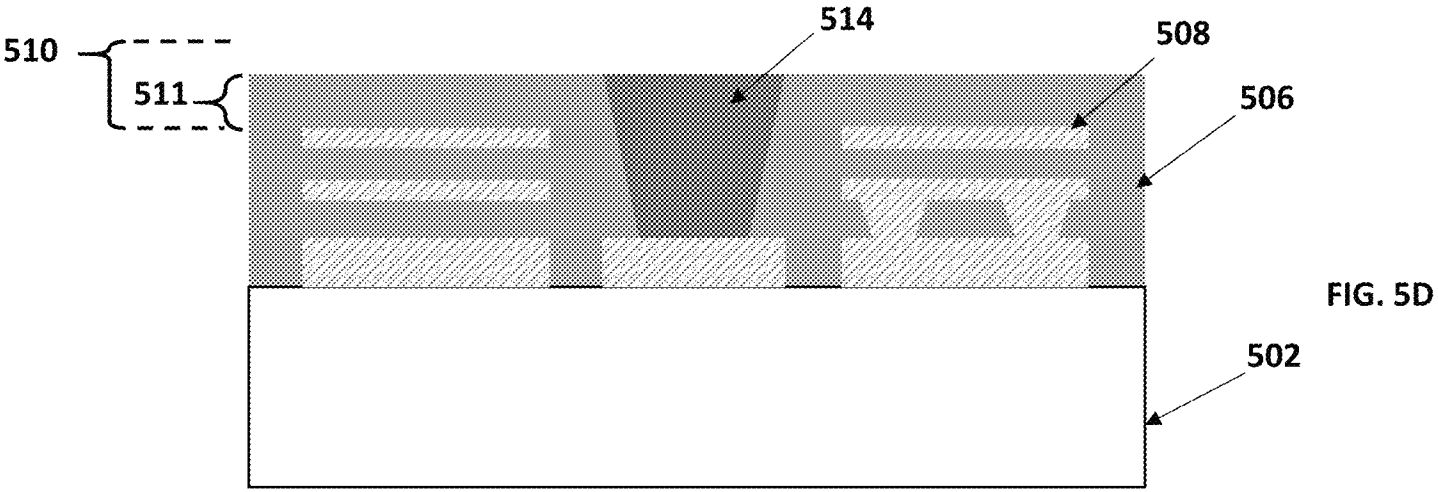

FIGS. 5A-E are schematic diagrams illustrating a process flow for forming a layered MCI in accordance with other embodiments of the present disclosure. FIG. 5A illustrates forming a "dummy" copper pad 505 on a core material 502 adjacent to the first copper layer 504. In FIG. 5B, the laminate 506 and other copper layers 507 are formed including a penultimate layer 508. The laminate 506 is formed to a thickness 510 that is 5-10 μm thicker than an intended target thickness. In FIG. 5C, a laser can be used to form the cavity 512. The laser can drill through the laminate 506 until the laser light beam reflects off of the dummy copper pad 505. The reflected light from the dummy copper pad 505 can be used by the laser to turn off the light beam. The dummy copper pad 505 can also prevent the laser light from further penetrating into the core material 502. In FIG. 5D, the nonconductive magnetic material 514 can be added into the cavity 512. The nonconductive magnetic material 514 can be cured to set. The top layer of the laminate 506 and the nonconductive magnetic material 514 is grinded to the target thickness 511, which is less than the laminate thickness 510.

Figure 5E:
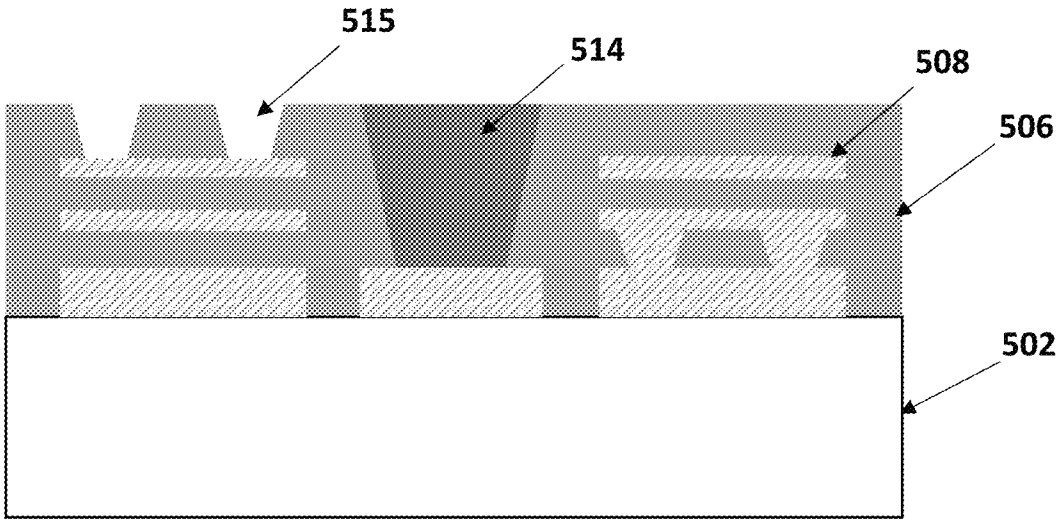
Figure 5F:
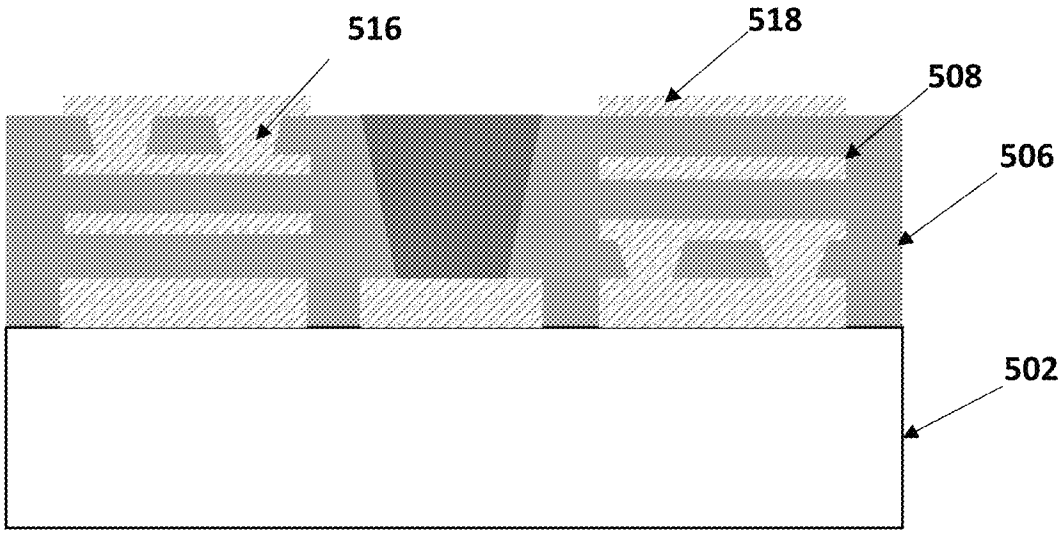

In FIG. 5E, the vias 515 can be formed. The vias 515 can be formed by a laser-based via formation to provide access to the penultimate copper layer 508. In FIG. 5F, the top copper layer 518 can be formed. The top copper layer 518 can be electrically connected to the penultimate copper layer 508 by copper contact vias 516.

Figure 6:
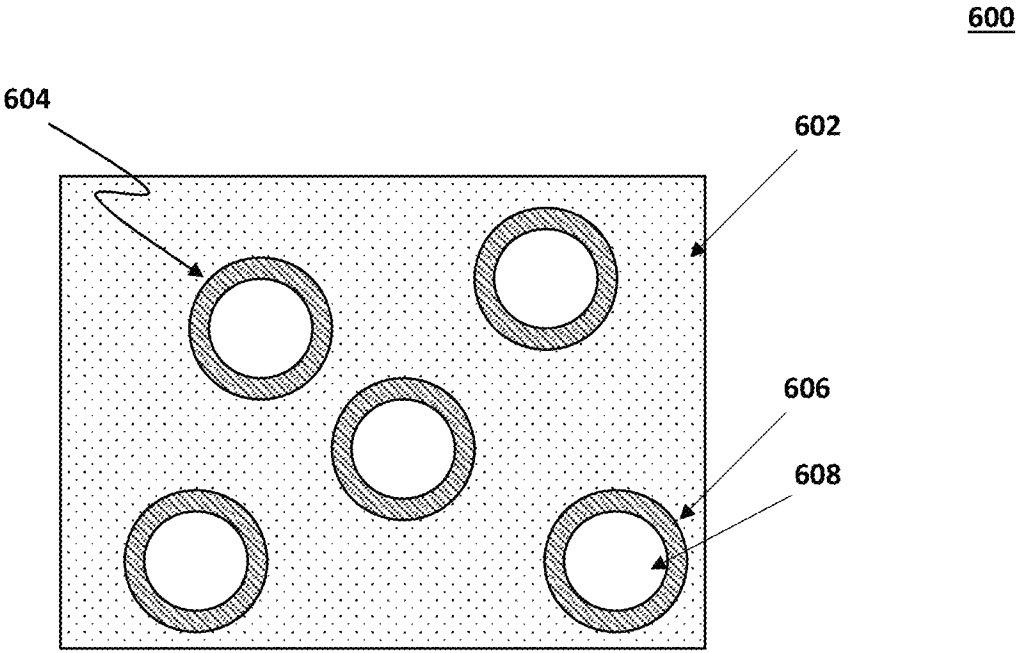
FIG. 6 is a schematic diagram of a nonconductive magnetic material in accordance with some embodiments of the present disclosure.

FIG. 6 is a schematic diagram illustrating an example nonconductive magnetic material 600 in accordance with embodiments of the present disclosure. In embodiments, the nonconductive magnetic material 600 can include a resin paste 602. The resin paste 602 can be a material that is responsive to curing, such as temperature or pressure curing. Curing the resin paste 602 can cause the resin paste 602 to harden. The resin paste 602 can include a plurality of nonconductive magnetic particles 604. The nonconductive magnetic particles 604 can include a shell 606 made from a nonconductive material, such as $SiO_2$. The nonconductive magnetic particles 604 can include a magnetic core 608 that is surrounded by the nonconductive shell 606.

Figure 7:
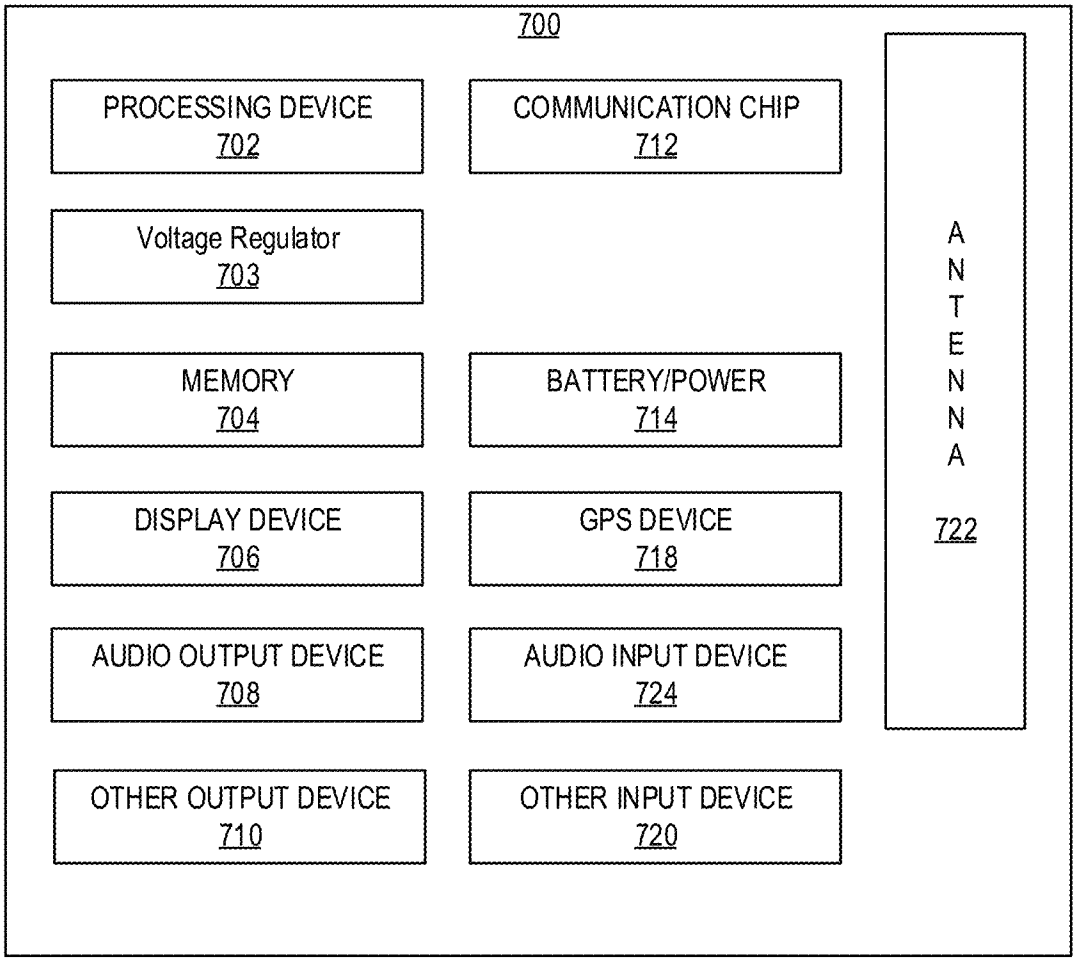
FIG. 7 is a block diagram of an example electrical device that may include one or more magnetic core inductors in accordance with any of the embodiments disclosed herein.

FIG. 7 is a block diagram of an example electrical device 700 that may include one or more magnetic core inductors in accordance with any of the embodiments disclosed herein. A number of components are illustrated in FIG. 7 as included in the electrical device 700, but any one or more of these components may be omitted or duplicated, as suitable for the application. In some embodiments, some or all of the components included in the electrical device 700 may be attached to one or more motherboards. In some embodiments, some or all of these components are fabricated onto a single system-on-a-chip (SoC) die.

Additionally, in various embodiments, the electrical device 700 may not include one or more of the components illustrated in FIG. 7, but the electrical device 700 may include interface circuitry for coupling to the one or more components. For example, the electrical device 700 may not include a display device 706, but may include display device interface circuitry (e.g., a connector and driver circuitry) to which a display device 706 may be coupled. In another set of examples, the electrical device 700 may not include an audio input device 724 or an audio output device 708, but may include audio input or output device interface circuitry (e.g., connectors and supporting circuitry) to which an audio input device 724 or audio output device 708 may be coupled.

The electrical device 700 can be implemented as an integrated circuit or as a plurality of integrated circuits. Each integrated circuit can be formed on a die coupled to a package substrate. The die can be mounted onto a package substrate that interconnects the die to other components of the electrical device 700. A voltage regulator 703 can be integrated on the die (e.g., as is the case for a fully integrated voltage regulator). The magnetic core inductors described herein can also be integrated on the die as a passive component of the voltage regulator 703. The voltage regulator 703 provides power to the various circuit components of the electrical device, such as the processing device 702 and/or the communication chip 712.

The electrical device 700 may include a processing device 702 (e.g., one or more processing devices). As used herein, the term "processing device" or "processor" may refer to any device or portion of a device that processes electronic data from registers and/or memory to transform that electronic data into other electronic data that may be stored in registers and/or memory. The processing device 702 may include one or more digital signal processors (DSPs), application-specific integrated circuits (ASICs), CPUs, graphics processing units (GPUs), cryptoprocessors (specialized processors that execute cryptographic algorithms within hardware), server processors, or any other suitable processing devices. The electrical device 700 may include a memory 704, which may itself include one or more memory devices such as volatile memory (e.g., dynamic random access memory (DRAM)), nonvolatile memory (e.g., read-only memory (ROM)), flash memory, solid state memory, and/or a hard drive. In some embodiments, the memory 704 may include memory that shares a die with the processing device 702. This memory may be used as cache memory and may include embedded dynamic random access memory (eDRAM) or spin transfer torque magnetic random access memory (STT-MRAM).

The electrical device 700 can include a voltage regulator 703. Voltage regulator 703 can convert supply voltage into usable voltage for the processor 702. When connected to multiple processors, the voltage regulator 703 can allow processors with different supply voltage to be mounted on the same motherboard. In some embodiments, the voltage regulator 703 can be a FIVR.

In some embodiments, the electrical device 700 may include a communication chip 712 (e.g., one or more communication chips). For example, the communication chip 712 may be configured for managing wireless communications for the transfer of data to and from the electrical device 700. The term "wireless" and its derivatives may be used to describe circuits, devices, systems, methods, techniques, communications channels, etc., that may communicate data through the use of modulated electromagnetic radiation through a nonsolid medium. The term does not imply that the associated devices do not contain any wires, although in some embodiments they might not.

The communication chip 712 may implement any of a number of wireless standards or protocols, including but not limited to Institute for Electrical and Electronic Engineers (IEEE) standards including Wi-Fi (IEEE 802.11 family), IEEE 802.16 standards (e.g., IEEE 802.16-2005 Amendment), Long-Term Evolution (LTE) project along with any amendments, updates, and/or revisions (e.g., advanced LTE project, ultra mobile broadband (UMB) project (also referred to as "3GPP2"), etc.). IEEE 802.16 compatible Broadband Wireless Access (BWA) networks are generally referred to as WiMAX networks, an acronym that stands for Worldwide Interoperability for Microwave Access, which is a certification mark for products that pass conformity and interoperability tests for the IEEE 802.16 standards. The communication chip 712 may operate in accordance with a Global System for Mobile Communication (GSM), General Packet Radio Service (GPRS), Universal Mobile Telecommunications System (UMTS), High Speed Packet Access (HSPA), Evolved HSPA (E-HSPA), or LTE network. The communication chip 712 may operate in accordance with Enhanced Data for GSM Evolution (EDGE), GSM EDGE Radio Access Network (GERAN), Universal Terrestrial Radio Access Network (UTRAN), or Evolved UTRAN (E-UTRAN). The communication chip 712 may operate in accordance with Code Division Multiple Access (CDMA), Time Division Multiple Access (TDMA), Digital Enhanced Cordless Telecommunications (DECT), Evolution-Data Optimized (EV-DO), and derivatives thereof, as well as any other wireless protocols that are designated as 3G, 4G, 5G, and beyond. The communication chip 712 may operate in accordance with other wireless protocols in other embodiments. The electrical device 700 may include an antenna 722 to facilitate wireless communications and/or to receive other wireless communications (such as AM or FM radio transmissions).

In some embodiments, the communication chip 712 may manage wired communications, such as electrical, optical, or any other suitable communication protocols (e.g., the Ethernet). As noted above, the communication chip 712 may include multiple communication chips. For instance, a first communication chip 712 may be dedicated to shorter-range wireless communications such as Wi-Fi or Bluetooth, and a second communication chip 712 may be dedicated to longer-range wireless communications such as global positioning system (GPS), EDGE, GPRS, CDMA, WiMAX, LTE, EV-DO, or others. In some embodiments, a first communication chip 712 may be dedicated to wireless communications, and a second communication chip 712 may be dedicated to wired communications.

The electrical device 700 may include battery/power circuitry 714. The battery/power circuitry 714 may include one or more energy storage devices (e.g., batteries or capacitors) and/or circuitry for coupling components of the electrical device 700 to an energy source separate from the electrical device 700 (e.g., AC line power).

The electrical device 700 may include a display device 706 (or corresponding interface circuitry, as discussed above). The display device 706 may include any visual indicators, such as a heads-up display, a computer monitor, a projector, a touchscreen display, a liquid crystal display (LCD), a light-emitting diode display, or a flat panel display.

The electrical device 700 may include an audio output device 708 (or corresponding interface circuitry, as discussed above). The audio output device 708 may include any device that generates an audible indicator, such as speakers, headsets, or earbuds.

The electrical device 700 may include an audio input device 724 (or corresponding interface circuitry, as discussed above). The audio input device 724 may include any device that generates a signal representative of a sound, such as microphones, microphone arrays, or digital instruments (e.g., instruments having a musical instrument digital interface (MIDI) output).

The electrical device 700 may include a GPS device 718 (or corresponding interface circuitry, as discussed above). The GPS device 718 may be in communication with a satellite-based system and may receive a location of the electrical device 700, as known in the art.

The electrical device 700 may include another output device 710 (or corresponding interface circuitry, as discussed above). Examples of the other output device 710 may include an audio codec, a video codec, a printer, a wired or wireless transmitter for providing information to other devices, or an additional storage device.

The electrical device 700 may include another input device 720 (or corresponding interface circuitry, as discussed above). Examples of the other input device 720 may include an accelerometer, a gyroscope, a compass, an image capture device, a keyboard, a cursor control device such as a mouse, a stylus, a touchpad, a bar code reader, a Quick Response (QR) code reader, any sensor, or a radio frequency identification (RFID) reader.

The electrical device 700 may have any desired form factor, such as a hand-held or mobile electrical device (e.g., a cell phone, a smart phone, a mobile internet device, a music player, a tablet computer, a laptop computer, a netbook computer, an ultrabook computer, a personal digital assistant (PDA), an ultra mobile personal computer, etc.), a desktop electrical device, a server or other networked computing component, a printer, a scanner, a monitor, a set-top box, an entertainment control unit, a vehicle control unit, a digital camera, a digital video recorder, or a wearable electrical device. In some embodiments, the electrical device 700 may be any other electronic device that processes data.

It is understood that the subject matter of the present description is not necessarily limited to specific applications illustrated in FIGS. 1-7. The subject matter may be applied to other microelectronic device and assembly applications, as well as any appropriate heat removal application, as will be understood to those skilled in the art.

The above description of illustrated implementations of the disclosure, including what is described in the Abstract, is not intended to be exhaustive or to limit the disclosure to the precise forms disclosed. While specific implementations of, and examples for, the disclosure are described herein for illustrative purposes, various equivalent modifications are possible within the scope of the disclosure, as those skilled in the relevant art will recognize.

These modifications may be made to the disclosure in light of the above detailed description. The terms used in the following claims should not be construed to limit the disclosure to the specific implementations disclosed in the specification and the claims.

The relative sizes of features shown in the figures are not drawn to scale.

The following paragraphs provide examples of various ones of the embodiments disclosed herein.

Example 1 is an inductor that includes a first metal filled through hole; a second metal filled through hole; and a nonconductive magnetic material surrounding the first and second metal plated through holes.

Example 2 may include the subject matter of example 1, wherein the first metal filled through hole is electrically coupled to the second metal filled through hole by a metal interconnect.

Example 3 may include the subject matter of example 2, wherein the metal interconnect is physically isolated from the nonconductive magnetic material.

Example 4 may include the subject matter of any of examples 1 or 3, and may also include metal in contact between the nonconductive magnetic material and the first metal filled through hole.

Example 5 may include the subject matter of any of examples 1-4, wherein the nonconductive magnetic material comprises a resin that comprises a plurality of nonconductive magnetic particles.

Example 6 may include the subject matter of example 5, wherein the nonconductive magnetic particles comprise a magnetic core surrounded by a nonconductive shell.

Example 7 may include the subject matter of example 6, wherein the nonconductive shell comprises silicon dioxide.

Example 8 is an inductor that includes a substrate; a first metal ring contacting the substrate; a laminate material within the first metal ring and contacting the substrate and a top wall of the first metal ring; a nonconductive magnetic material within the first metal ring and contacting the laminate material; and a second metal ring electrically coupled to the first metal ring, the nonconductive magnetic material within the second metal ring.

Example 9 may include the subject matter of example 8, wherein the laminate material surrounds the first metal ring and the second metal ring; and wherein the laminate material resides between an inner wall of the second metal ring and the nonconductive magnetic material.

Example 10 may include the subject matter of any of examples 8 or 9, further comprising a third metal ring, the third metal ring residing on the laminate.

Example 11 may include the subject matter of any of examples 8-10, further comprising a metal interconnect electrically coupling the first metal filled through hole to the second metal filled through hole.

Example 12 may include the subject matter of any of examples 8-11, wherein the nonconductive magnetic material comprises a resin that comprises a plurality of nonconductive magnetic particles.

Example 13 may include the subject matter of example 12, wherein the nonconductive magnetic particles comprise a magnetic core surrounded by a nonconductive shell.

Example 14 may include the subject matter of example 13, wherein the nonconductive shell comprises silicon dioxide.

Example 15 is a method for forming a magnetic core inductor, the method including providing a base material; forming an opening in the base material; providing a nonconductive magnetic material to the opening; forming a first through hole in the nonconductive magnetic material; forming a second through hole in the nonconductive magnetic material, the first and second through holes separated by the nonconductive magnetic material; providing a first metal filled through hole to the first through hole; and providing a second metal filled through hole to the second through hole.

Example 16 may include the subject matter of example 15, and can also include filling the first and second metal plated through holes with an epoxy.

Example 17 may include the subject matter of example 15, wherein the plating is performed by electroless plating of copper.

Example 18 may include the subject matter of any of examples 15-17, wherein forming the opening in the base material comprises creating the opening using a router.

Example 19 may include the subject matter of any of examples 15-18, wherein the base material comprises copper.

Example 20 may include the subject matter of any of examples 15-19, wherein providing the nonconductive magnetic material to the opening comprises providing a nonconductive magnetic paste to the opening; curing the nonconductive magnetic paste to form a cured nonconductive magnetic material, and planarizing the cured nonconductive material.

Example 21 may include the subject matter of any of examples 15-20, wherein providing the nonconductive magnetic material providing a stencil to cover the base material and expose the opening; and providing the nonconductive magnetic material to the opening.

Example 22 may include the subject matter of any of examples 15-21, and can also include forming a third through hole through the base material; plating the third through hole; and providing a third metal filled through hole to the plated third through hole.

Example 23 may include the subject matter of any of examples 15-22, and can also include providing dielectric cap to the first and second metal filled through holes.

Example 24 may include the subject matter of any of examples 15-23, and can also include forming a via through the dielectric cap to expose the first metal filled through hole; forming a first electrical contact electrically connected to the first metal filled through hole; and forming a contact pad electrically connected to the first electrical contact.

Example 25 is a method for forming a layered magnetic core inductor, the method including forming, on a base material, a first metal ring of a layered inductor; forming, on the first metal ring, a first layer of a laminate material; forming, on the first layer of the laminate material, a second metal ring; forming, on the second metal ring, a second layer of the laminate material; forming a cavity in the laminate material through the second metal ring; and providing a nonconductive magnetic material in the cavity.

Example 26 may include the subject matter of example 25, wherein forming the second layer of the laminate material comprises forming the second layer of the laminate material to a first thickness; the method also including grinding the second layer of the laminate material and the nonconductive magnetic material to a second thickness.

Example 27 may include the subject matter of any of examples 25 or 26, and can also include forming a via in the laminate material; forming an electrical contact in the via; and forming a third metal ring on the laminate material electrically coupled to the second metal ring through the electrical contact.

Example 28 may include the subject matter of any of examples 25-27, wherein forming the cavity comprises depth controlled drilling of the laminate to a depth proximate the first metal ring.

Example 29 may include the subject matter of any of examples 25-27, and can also include forming a metal contact pad on the base material within the first metal ring; wherein forming the cavity comprises: laser drilling the laminate material through the second metal ring; and stopping the laser upon detection of laser light reflected from the metal contact pad.

Example 30 may include the subject matter of example 25-29, and can also include forming a via in the first laminate material; forming an electrical contact in the via; and wherein forming, on the first layer of the laminate material, a second metal ring comprises electrically connecting the second metal ring to the first metal ring by the electrical contact.

Example 31 may include the subject matter of any of examples 25-30, wherein providing a nonconductive magnetic material in the cavity include providing a nonconductive magnetic resin paste to the cavity; and thermally curing the resin paste to solidify the resin paste.

Example 32 may include the subject matter of any of examples 25-31, wherein the nonconductive resin paste comprises nonconductive magnetic particles.

Example 33 is a computing device that includes a processor mounted on a substrate; a communications logic unit within the processor; a memory within the processor; and a voltage regulator within the processor; wherein the voltage regulator comprises an inductor, the inductor including a first metal filled through hole; a second metal filled through hole; and a nonconductive magnetic material surrounding the first and second metal plated through holes.

Example 34 is a computing device that includes a processor mounted on a substrate; a communications logic unit within the processor; a memory within the processor; and a voltage regulator coupled to the processor; wherein the voltage regulator comprises an inductor, the inductor including a substrate; a first metal ring contacting the substrate; a laminate material within the first metal ring and contacting the substrate and a top wall of the first metal ring; a nonconductive magnetic material within the first metal ring and contacting the laminate material; and a second metal ring electrically coupled to the first metal ring, the nonconductive magnetic material within the second metal ring.

Example 35 may include the subject matter of any of examples 33-34, wherein the voltage regulator is a fully integrated voltage regulator.

The invention claimed is:

1. An inductor comprising:

a substrate;

a first metal ring contacting the substrate;

a laminate material within the first metal ring and contacting the substrate and a top wall of the first metal ring;

a second metal ring electrically coupled to the first metal ring; and a nonconductive magnetic material within the second ring and the laminate material of the first ring, wherein the nonconductive magnetic material contacts the substrate and top wall of the first metal ring.

2. The inductor of claim 1, wherein the laminate material surrounds the first metal ring and the second metal ring; and wherein the laminate material resides between an inner wall of the second metal ring and the nonconductive magnetic material.

3. The inductor of claim 1, further comprising a metal interconnect electrically coupling the first metal plated through hole to the second metal plated through hole.

4. The inductor of claim 1, wherein the nonconductive magnetic particles comprise a magnetic core surrounded by a shell comprising a nonconductive material.

5. A method for forming a layered magnetic core inductor, the method comprising:

forming, on a base material, a first metal ring of a layered inductor;

forming, on the first metal ring, a first layer of a laminate material;

forming, on the first layer of the laminate material, a second metal ring;

forming, on the second metal ring, a second layer of the laminate material;

forming a cavity in the second layer of the laminate material through the second metal ring; and providing a nonconductive magnetic material in the cavity.

6. The method of claim 5, further comprising:

forming a via in the laminate material;

forming an electrical contact in the via; and forming a third metal ring on the laminate material electrically coupled to the second metal ring through the electrical contact.

7. The method of claim 5, wherein forming the cavity comprises depth controlled drilling of the laminate material to a depth proximate the first metal ring.

8. The method of claim 5, further comprising:

forming a metal contact pad in on a surface of the base material within the first metal ring;

wherein forming the cavity comprises:

laser drilling the laminate material through the second metal ring; and stopping the laser upon detection of laser light reflected from the metal contact pad.

9. The method of claim 5, wherein providing a nonconductive magnetic material in the cavity comprises:

providing a nonconductive magnetic resin paste to the cavity; and thermally curing the nonconductive magnetic resin paste to solidify the nonconductive magnetic resin paste.

10. The method of claim 5, wherein the nonconductive magnetic material comprises particles comprising a magnetic core surrounded by a shell comprising a nonconductive material.

11. The method of claim 5, further comprising:

forming a via in the first layer of laminate material;

forming an electrical contact in the via; and wherein forming, on the first layer of the laminate material, a second metal ring comprises electrically connecting the second metal ring to the first metal ring by the electrical contact.

* * * * *